US008746831B2

(12) United States Patent
Arakane

(10) Patent No.: US 8,746,831 B2
(45) Date of Patent: Jun. 10, 2014

(54) IMAGE RECORDING APPARATUS INCLUDING JUDGING PORTION FOR JUDGING WHETHER IMAGE HAS BEEN ALREADY RECORDED ONTO MEDIUM

(75) Inventor: Satoru Arakane, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 255 days.

(21) Appl. No.: 13/034,212

(22) Filed: Feb. 24, 2011

(65) Prior Publication Data

US 2011/0234674 A1 Sep. 29, 2011

(30) Foreign Application Priority Data

Mar. 25, 2010 (JP) ..... 2010-069360

(51) Int. Cl.
*B41J 29/38* (2006.01)
*B41J 11/42* (2006.01)

(52) U.S. Cl.
CPC ..... *B14J 11/0095* (2013.01); *B41J 11/42* (2013.01)
USPC ..... 347/16; 347/14

(58) Field of Classification Search
CPC ..... B41J 2/04541; B41J 2/04543; B41J 2/04563; B41J 2/0458; B41J 2/04581; B41J 2/04591; B41J 3/60; B41J 11/0095; B41J 11/42; B41J 29/38; B41J 29/393
USPC ..... 347/2, 4, 5, 16, 19, 101, 104, 106, 107, 347/109, 14; 101/218; 358/400; 399/82; 400/615.2
See application file for complete search history.

(56) References Cited

U.S. PATENT DOCUMENTS

| | | | | |
|---|---|---|---|---|
| 6,106,094 | A | 8/2000 | Otani et al. | |
| 6,240,242 | B1 * | 5/2001 | Takeuchi | 386/241 |
| 2004/0061757 | A1 * | 4/2004 | Yanagi et al. | 347/101 |
| 2005/0264851 | A1 * | 12/2005 | Hara | 358/3.28 |

(Continued)

FOREIGN PATENT DOCUMENTS

| | | | |
|---|---|---|---|
| CN | 1704990 | A | 12/2005 |
| JP | H09-136411 | A | 5/1997 |

(Continued)

OTHER PUBLICATIONS

Chinese Office Action dated Mar. 28, 2013 issued in corresponding Chinese Patent Application No. 201110064103.0, together with English language translation.

(Continued)

*Primary Examiner* — Manish S Shah
*Assistant Examiner* — Roger W Pisha, II
(74) *Attorney, Agent, or Firm* — Scully, Scott, Murphy & Presser, PC

(57) ABSTRACT

An image recording apparatus includes: a tray for holding a medium; a conveying portion for conveying the tray; a recording portion for recording an image onto the medium held by the tray; a detecting portion for detecting the medium. A detection-region determining portion determines, a detection region of the medium which is to be detected and a detection-region memory portion memorizes the determined detection region. Prior to the next image recording, the detecting portion detects the detection region, based on the detection region that has been memorized in previous image recording. A judging portion judges whether the image has been already recorded onto the medium or not, based on result of detection made by the detecting portion.

15 Claims, 13 Drawing Sheets

(56) References Cited

U.S. PATENT DOCUMENTS

| | | | | |
|---|---|---|---|---|
| 2007/0188587 | A1* | 8/2007 | Kwasny et al. | 347/224 |
| 2008/0136885 | A1* | 6/2008 | Ishii et al. | 347/104 |
| 2009/0184989 | A1* | 7/2009 | Block et al. | 347/5 |
| 2009/0284562 | A1* | 11/2009 | Komuro et al. | 347/16 |
| 2009/0284765 | A1* | 11/2009 | Iezaki et al. | 358/1.9 |

FOREIGN PATENT DOCUMENTS

| | | | | | |
|---|---|---|---|---|---|
| JP | 2004058291 | A | * | 2/2004 | B41J 11/42 |
| JP | 2005-085020 | A | | 3/2005 | |
| JP | 2006-085066 | A | | 3/2006 | |
| JP | 2006085066 | A | * | 3/2006 | G03G 21/00 |
| JP | 2007-276253 | A | | 10/2007 | |
| JP | 2009-100038 | A | | 5/2009 | |

OTHER PUBLICATIONS

Chinese Official Action dated Nov. 19, 2013 received in related application CN 201110064103.0.

* cited by examiner

IMAGE RECORDING APPARATUS INCLUDING JUDGING PORTION FOR JUDGING WHETHER IMAGE HAS BEEN ALREADY RECORDED ONTO MEDIUM

CROSS REFERENCE TO RELATED APPLICATION

This application claims priority from Japanese Patent Application No. 2010-069360 filed on Mar. 25, 2010, the disclosure of which is herein incorporated by reference in its entirety.

BACKGROUND OF THE INVENTION

Field of the Invention

The present invention relates to an image recording apparatus including a tray which is configured to hold a recording medium and which is to be conveyed.

The image recording apparatus is configured to perform image recording onto a recording medium while conveying the recording medium. An inkjet image recording apparatus is capable of performing image recording onto various kinds of recording media such as a recording sheet (e.g., recording paper) and an object (e.g., CD, DVD or the like).

Where image recording is to be performed onto CD or DVD in the image recording apparatus, the image recording is performed onto the CD or DVD, with the CD or DVD being held on a tray (that is designed for holding exclusively the CD or DVD) and being conveyed along a conveyance path. Prior to such an image recording, the tray is introduced into the conveyance path via an introduction opening that is provided in a front surface of the image recording apparatus. After having been introduced together with the tray into the conveyance path, the CD or DVD is subjected to image recording performed in response to user's command requesting the image recording. After having been subjected to the image recording, the CD or DVD is discharged together with the tray from the conveyance path via the introduction opening.

However, there is a case where the tray holding the CD or DVD on which image recording has been completed is caused to be erroneously introduced back into the conveyance path, due to, for example, user's operational error, so that the same CD or DVD is subjected to another image recording although the image has been already recorded onto the same CD or DVD. For avoiding such a problem, there is known an arrangement in which a recorded surface of the CD or DVD is detected by a sensor. In the disclosed arrangement, when it is judged that image recording has been performed, the user is informed of that effect, for thereby preventing user's operational error that could cause another image recording to be erroneously performed onto the same CD or DVD.

SUMMARY OF THE INVENTION

The above-described sensor, which is configured to detect a recorded surface of the CD or DVD, is commonly disposed on a structure (e.g., a carriage carrying a recording portion) that is reciprocatively movable in a main scanning direction perpendicular to a tray conveyance direction in which the tray is to be conveyed. The detection of the recorded surface by the sensor is performed by movement of the carriage in the main scanning direction and conveyance of the tray in the tray conveyance direction, which are alternately repeated. However, for judging whether the recorded surface has been already subjected to image recording or not, the movement of the carriage in the main scanning direction and the conveyance of the tray in the tray conveyance direction have to be repeated a plurality of times. Therefore, the judgment as to whether the image recording has been already performed onto the recorded surface requires a large length of time.

The present invention was made in view of such a background. It is therefore an object of the invention to provide an image recording apparatus in which, where a tray holding a recording medium onto which image recording has been already performed is erroneously introduced, the judgment that the recording medium held by the introduced tray has been already subjected to the image recording can be made in a short length of time.

The above object of the invention may be achieved according to a principle of the invention, which provides an image recording apparatus including: (a) a tray configured to hold a recording medium; (b) a conveying portion configured to convey the tray in a conveyance direction that is perpendicular to a main scanning direction; (c) a recording portion configured to record an image onto the recording medium that is held by the tray; (d) a detecting portion movable in the main scanning direction and configured to detect the recording medium and the tray; (e) a detection-region determining portion configured to determine, based on a recorded region of the recording medium in which the image is recorded by the recording portion, a detection region of the recording medium, the detection region being to be detected by the detecting portion; (f) a detection-region memory portion configured to memorize the detection region that has been determined by the detection-region determining portion; (g) a controlling portion configured to cause, prior to next recording of the image onto the recording medium that is held by the tray, the detecting portion to detect the detection region, by controlling the conveying portion and the detecting portion, based on the detection region that has been memorized in the detection-region memory portion in previous recording of the image; and (h) a judging portion configured to judge whether the image has been already recorded onto the recording medium or not, based on result of detection made by the detecting portion.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which.

DETAILED DESCRIPTION OF THE PREFERRED EMBODIMENT

There will be described a preferred embodiment of the invention, with reference to the drawings. It should be noted that the preferred embodiment is merely an example of the present invention, and that the embodiment may be modified or changed as needed without departing from the spirit of the invention.

<Overall Construction>

(Construction of Compound Machine 1)

Figure 1:
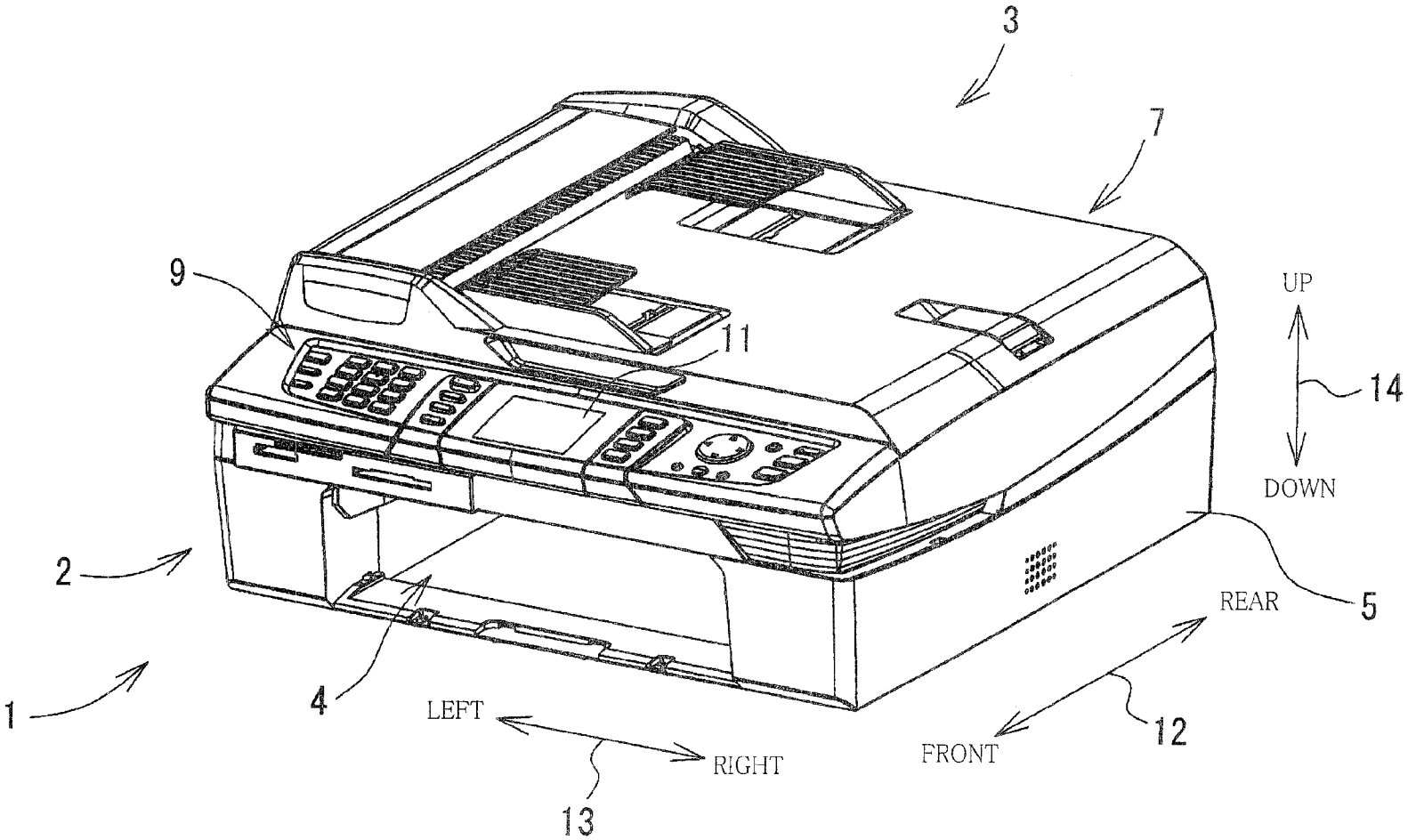
FIG. 1 is a perspective view showing an appearance of a compound machine 1 constructed according to an embodiment of the invention.

Referring first to FIG. 1, there will be described a compound machine 1 constructed according to an embodiment of the invention. In FIG. 1, an arrow denoted by reference sign 13 represents a direction of width of the compound machine 1, i.e., right and left directions of the machine 1; an arrow denoted by reference sign 14 represents a direction of height of the compound machine 1, i.e., upward and downward directions of the machine 1; and an arrow denoted by reference sign 12 represents a direction of depth of the compound machine 1, i.e., forward and rearward directions of the machine 1.

The compound machine 1 is a multi-function device (MFD) equipped integrally with a printer unit 2 and a scanner unit 3 that are constituted by a lower portion and an upper portion of the machine 1, respectively. The scanner unit 3 has, in its upper portion, a document cover 7 that is constituted by a top board of the compound machine 1. The compound machine 1 is arranged to perform various functions such as printer, scanner, copier and facsimile functions. It is noted that the scanner, copier and facsimile functions are optional functions and that the present invention can be carried out without the scanner, copier and facsimile functions. That is, an image recording apparatus according to the invention does not have to be constituted necessarily by the compound machine 1 but may be constituted by a printer having only the printer function.

The compound machine 1 has an operator's control panel 9 so that the printer unit 2 and the scanner unit 3 are operable through the control panel 9. The control panel 9 is disposed on a front upper portion of the machine 1, namely, on a front-side portion of the scanner unit 3, and includes various operating buttons and a display portion 11, so that the machine 1 can be controlled by a controlling portion 80 (see FIG. 5), in accordance with commands inputted through the control panel 9.

The scanner unit 3 is constituted by a so-called flatbed scanner unit, and has the above-described document cover 7 that is arranged to be freely openable. Below the document cover 7, there are disposed a platen glass (not shown) and an image sensor (not shown) that is disposed below the platen glass. The image sensor is configured to read an image carried on an original document that is set on the platen glass that is covered by the document cover 7.

<Construction of Each Unit>

(Construction of Printer Unit 2)

Referring next to FIGS. 1-4, there will be described the printer unit 2 in detail. As shown in FIG. 1, the printer unit 2 has a casing 5 which has an opening 4 provided in a front surface of the casing 5. Within the casing 5, there are disposed various elements of the printer unit 2.

Figure 2:
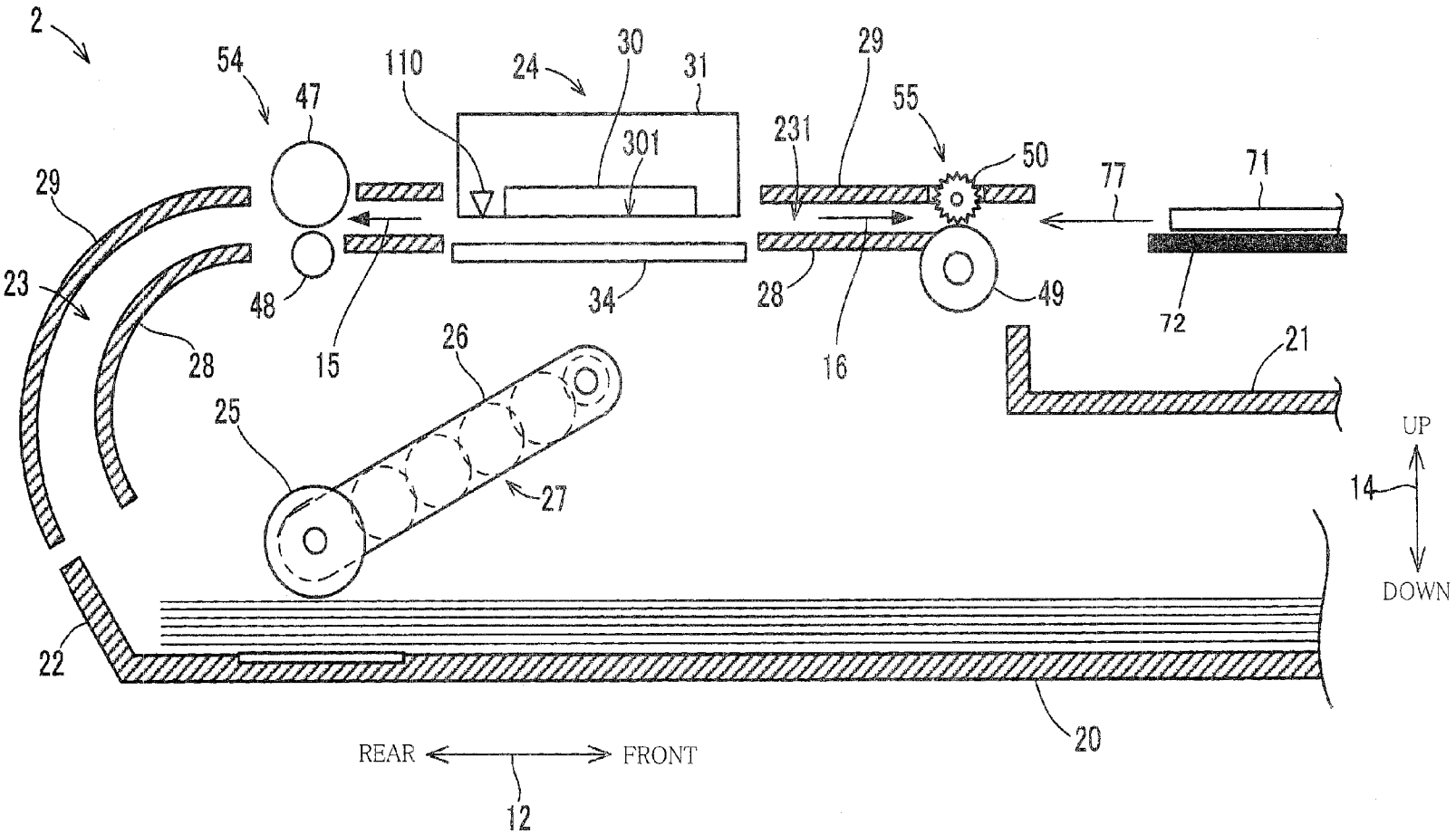
FIG. 2 is a side view in cross section showing an internal construction of a printer unit 2 of the compound machine 1.

A sheet supply tray 20 and a sheet exit tray 21 (which are not shown in FIG. 1) are introduced via the opening 4, so as to be fixedly disposed in the compound machine 1, as shown in FIG. 2. The sheet supply tray 20 accommodates desired-sized recording sheets such as A4-sized paper sheets and B5-sized paper sheets that are stacked on each other. The recording sheets are accommodated in the sheet supply tray 20 such that a longitudinal direction of the accommodated sheets are coincident with the depth direction 12 of the compound machine 1 when the sheet supply tray 20 is being disposed in the compound machine 1. The sheet exit tray 21 is disposed above the sheet supply tray 20 that supports the sheet exit tray 21. Thus, the sheet supply tray 20 and the sheet exist tray 21 cooperate with each other to constitute a double-deck tray assembly that is fixedly disposed in the machine 1.

The compound machine 1 has a function for recording image onto not only a recording sheet but also other recording media such as CD-ROM and DVD-ROM. This function will be described later.

(Sheet Supplying Portion)

As shown in FIG. 2, a slant sheet-separator plate 22 is provided in a rear end portion of the sheet supply tray 20 that is attached to the compound machine 1. The slant sheet-separator plate 22 serves to separate an uppermost one of the recording sheets from the other sheets and to upwardly guide the separated recording sheet.

A sheet supply roller 25 is disposed above the sheet supply tray 20, so as to separate one by one the recording sheets stacked on the sheet supply tray 20 and supply toward a sheet conveyance path 23. The sheet supply roller 25 is rotatably held by a distal end portion of a sheet supply arm 26 that is vertically displaceable toward and away from the sheet supply tray 20. The sheet supply roller 25 is rotated by a drive force transmitted from a sheet supply motor 76 (see FIG. 5) via a drive-force transmitting mechanism 27 that is constituted by a plurality of gears meshing with each other and fixed to the sheet supply arm 26. With rotation of the sheet supply roller 25 that is held in pressing contact with the recording sheets stacked on the sheet supply tray 20, an uppermost one of the recording sheets is moved toward the slant sheet-separator plate 22, owing to a frictional force generated between a surface of the sheet supply roller 25 and the upper most recording sheet. The moved recording sheet is brought into contact at its leading end portion with the slant sheet-separator plate 22, and is upwardly guided by the sheet-separator plate 22 so as to be conveyed to the sheet conveyance path 23.

(Sheet Conveyance Path 23)

The sheet conveyance path 23, which is defined above the sheet supply tray 20, extends upwardly from an upper side of the sheet-separator plate 22, and then curves toward a front side of the compound machine 1. Thus, the sheet conveyance path 23 extends generally in a direction away from a rear surface (rear side) of the compound machine 1 towards a front surface (front side) of the machine 1. The sheet conveyance path 23, extending generally away from the rear surface of the machine 1 toward the front surface of the machine 1, extends to the sheet exist tray 21 via a lower side of an image recording portion 24 and two nipping positions, wherein one of the two nipping positions is defined between a pair of feed rollers 54 constituted by a drive roller 47 and a pinch roller 48 while the other of the two nipping positions is defined between a pair of discharge rollers 55 constituted by a drive roller 49 and a spur roller (rowel) 50. The recording sheet supplied from the sheet supply tray 20 is guided by the conveyance path 23, so as to make U turn and reach the image recording portion 24. After being subjected to image recording performed by the recording portion 24, the recording sheet is discharged to the sheet exist tray 21. The conveyance path 23 is defined by cooperation of outside and inside guide surfaces 29, 28 that are opposed to each other with a predetermined distance therebetween, except its portions in which the image recording portion 24 is disposed. In the present embodiment, the feed rollers 54 and the discharge rollers 55 constitute an example of a conveying portion.

In the following descriptions, a term "second direction 16" (see FIG. 2), which is one of opposite directions parallel to a tray conveyance direction, indicates a direction in which the recording medium (such as a recording sheet, CD or DVD) is to be conveyed toward the sheet exist tray 21, via the nipping position defined between the pair of feed rollers 54, the lower side of the image recording portion 24 and the nipping position defined between the pair of discharge rollers 55. Meanwhile, a term "first direction 15" (see FIG. 2), which is the other of the opposite directions parallel to the tray conveyance direction, indicates a direction opposite to the second direction 16.

(Image Recording Portion 24)

The image recording portion 24 includes a recording head 30 and a carriage 31 which carries the recording head 30 and which is reciprocatable in a main scanning direction (that is perpendicular to drawing sheet of FIG. 2), namely, movable in opposite directions parallel to the main scanning direction. The recording head 30, which constitutes an example of a recording portion in the present embodiment, has a lower surface exposed downwardly from the carriage 31. To the recording head 30, cyan (C), magenta (M), yellow (Y) and black (Bk) inks are supplied from respective ink tanks 32 (see FIG. 3) via respective ink tubes 33 (see FIG. 3).

A plurality of nozzles 301 open in the lower surface, are arranged in four rows. The four rows extend in the conveyance direction, and are arranged in the main scanning direction (i.e. width direction 13). The nozzles 301 of each one of the four rows are assigned to eject a corresponding one of the four color inks, i.e., cyan (C), magenta (M), yellow (Y) and black (Bk) inks.

The recording head 30 is configured to eject, through each of the nozzles 301 opening in the lower surface, the corresponding ink in the form of micro-sized droplets. With reciprocative movement of the carriage 31 in the main scanning direction, the recording head 30 is caused to scan the recording medium, and an image is recorded onto the recording medium that is being conveyed above the platen 34.

Figure 3:
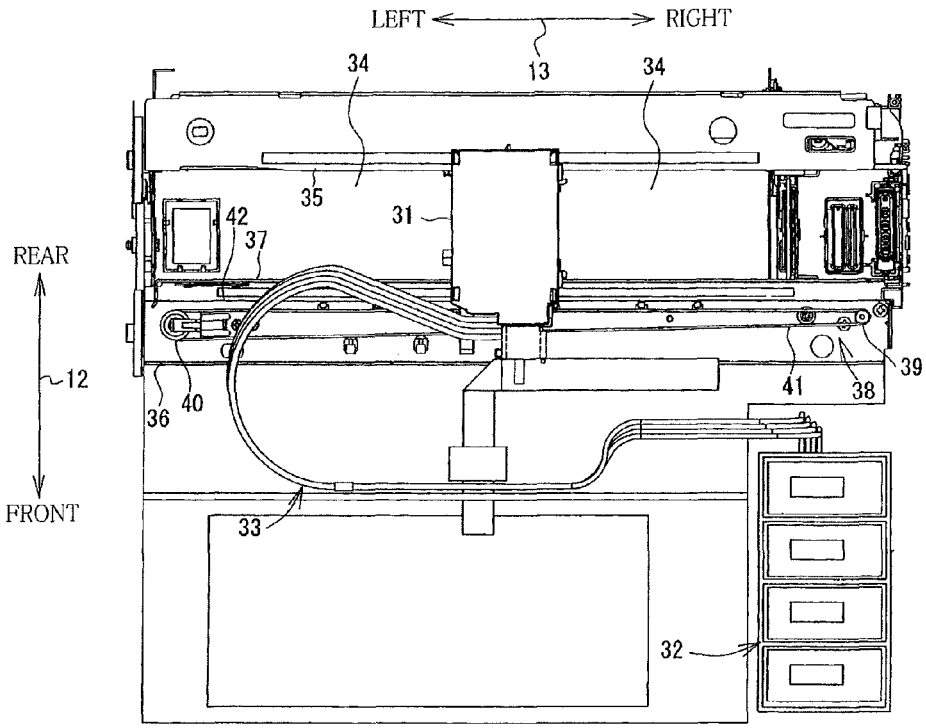
FIG. 3 is an upper plan view partially in cross section showing the internal construction of the printer unit 2.
Figure 4:
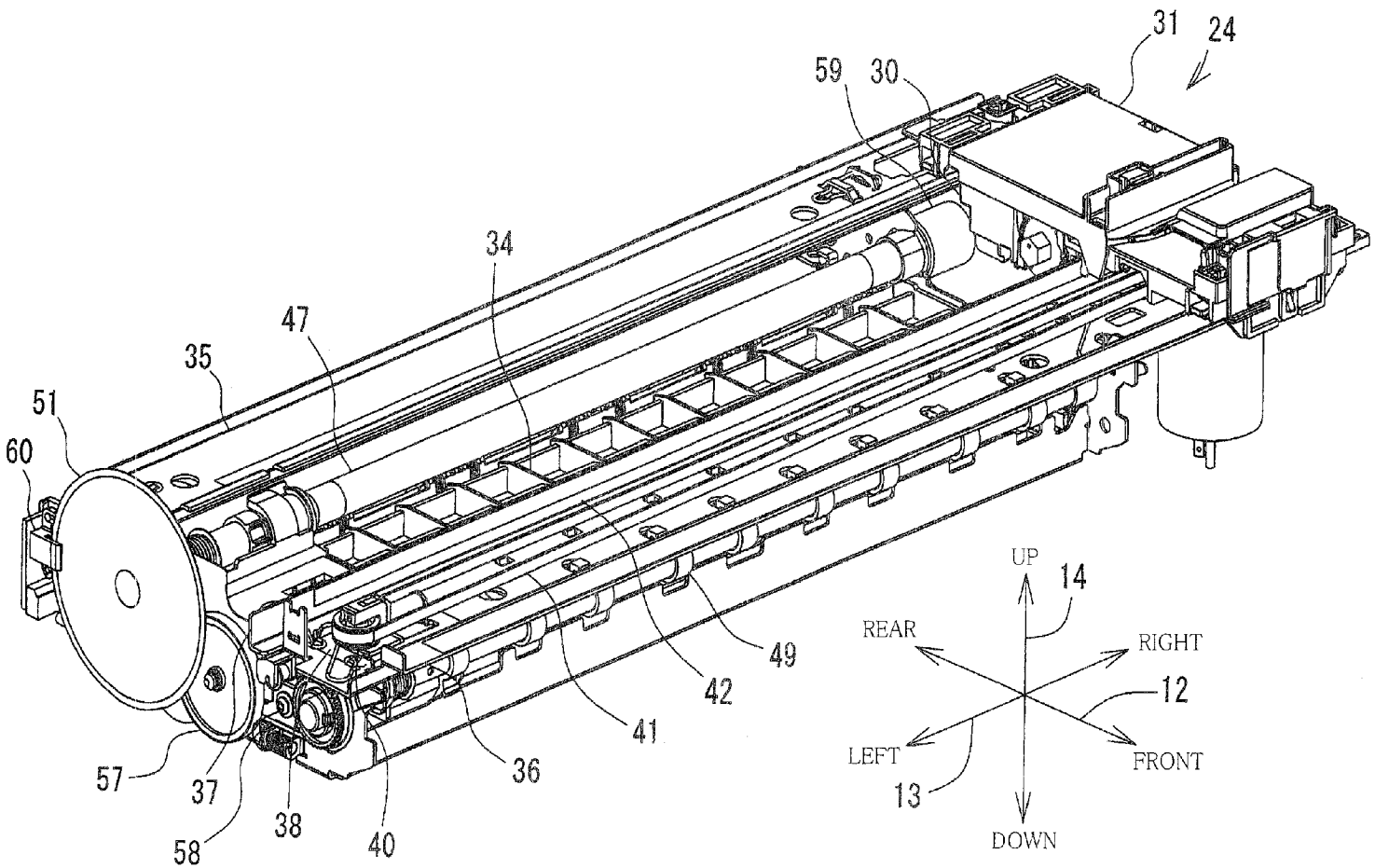
FIG. 4 is a perspective view showing mechanism of an image recording portion 24 included in the compound machine 1.

As shown in FIGS. 3 and 4, a pair of flat-plate-like guide rails 35, 36 are disposed on an upper side of a portion of the conveyance path 23 in which the image recording portion 24 is disposed. The guide rails 35, 36 are spaced apart from each other in the conveyance direction, and extend in the main scanning direction (i.e. width direction 13). The carriage 31 is arranged to straddle the guide rails 35, 36 so as to be slidable on the guide rails 35, 36 in opposite directions parallel to the main scanning direction.

A belt drive mechanism 38 is disposed on an upper surface of the guide rail 36. The belt drive mechanism 38 includes drive and driven pulleys 39, 40 that are disposed in respective opposite end portions of the conveyance path 23 in the width direction 13, and an endless timing belt 41 that has tooth formed in its inside surface. The endless timing belt 41 is wound on the drive and driven pulleys 39, 40, with a predetermined degree of tension being given to the timing belt 41. A carriage (CR) drive motor 331 (see FIG. 5) is connected to a shaft of the drive pulley 39, so that a drive force of the motor 331 can be applied to the shaft of the drive pulley 39. Thus, with rotation of the drive pulley 39, the timing belt 41 is circulated. It is noted that the endless timing belt 41 may be replaced by a timing belt having opposite ends so that the carriage 31 is fixed to the opposite ends of the timing belt.

The carriage 31 is fixed to a portion of the timing belt 41 so that the carriage 31 is reciprocatively movable on the guide rails 35, 36 by the circulating motion of the timing belt 41, with an end portion 37 of the guide rail 36 serving as a reference portion. The recording head 30 carried by the carriage 31 is reciprocatably movable together with the carriage 31 in the main scanning direction, i.e., in the width direction 13 of the conveyance path 23. The guide rail 36 is provided with an encoder strip 42 that is disposed on the end portion 37 of the guide rail 36. The encoder strip 42 cooperates with a photo interrupter (not shown) to constitute a linear encoder 62 (see FIG. 5). The photo interrupter is provided in the carriage 31 and arranged to detect the encoder strip 42. The reciprocative movement of the carriage 31 is controlled based on a detection signal supplied from the linear encoder 62.

As shown in FIGS. 2-4, the platen 34 is disposed on a lower side of the conveyance path 23 and is located in a position opposed to the recording head 30 in the height direction 14. The recording medium passes over a central region of a reciprocative movement range of the carriage 31. The platen 34 is arranged to extend over the central range. It is noted that the platen 34 has a width sufficiently larger than a width of a maximum-sized recording medium that can be used in the present compound machine 1 so that widthwise opposite ends of the recording medium necessarily pass over the platen 34.

(Media Sensor 110)

As shown in FIG. 2, a media sensor 110, which constitutes a detecting portion in the present embodiment, is provided in the compound machine 1, for detecting the recording medium conveyed along the conveyance path 23. The media sensor 110 is disposed on a portion of a lower surface of the carriage 34, which corresponds to a downstream end portion of the lower surface as viewed in the first direction 15. The media sensor 110 has a light emitting portion (not shown) and a light receiving portion (not shown) which are constituted by, for example, a light emitting diode and an optical sensor, respectively. The light emitting portion is configured to emit light downwardly, and the light receiving portion is configured to receive light reflected from the media tray 71, recording medium M or platen 34.

There will be described a process of detection or calculation of a position of a center of the recording medium M (such as circular-shaped CD or DVD) by the media sensor 110.

The media sensor 110 is reciprocatively movable together with the carriage 31 in the main scanning direction. When the carriage 31 is moved in the main scanning direction with the recording medium being positioned above the platen 34, the light receiving portion of the media sensor 110 receives light reflected from an upper surface of the platen 34, an upper surface of the media tray 71 or an upper surface of the recording medium during the movement of the carriage 31.

Where each of the upper surfaces of the platen 34 and the media tray 71 has a black color or other color having a low reflection factor, a value detected by the light receiving portion upon reception of light reflected from the recording medium M is different from a value detected by the light receiving portion upon reception of light reflected from the platen 34 or media tray 71. The detected value detected by the light receiving portion of the media sensor 110 is transmitted to the controlling portion 80, so that the controlling portion 80 acquires data representing positions of respective opposite edge portions of the recording medium M.

Then, after the media tray 71 has been conveyed by a given amount in the first direction 15 (see FIG. 2), the carriage 31 is moved in the main scanning direction, so that the controlling portion 80 further acquires other data representing positions of respective opposite edge portions of the recording medium M. Since the center and diameter of a circle can be calculated by knowing at least three points lying on periphery of the circle, the position of the center of the circular-shaped recording medium M can be calculated based on the data representing the positions of respective three of the edge portions of the recording medium M.

(Conveying Portion)

As shown in FIGS. 2 and 4, the pair of feed rollers 54 are disposed on an upstream side, as viewed in the second direction 16, of the image recording portion 24. The pair of feed rollers 54 constitute an unit including the drive roller 47 and the pinch roller 48 which is located below the drive roller 47 and is held in contact with the drive roller 47. With the drive roller 47 being rotated in a forward direction, the recording sheet supplied from the sheet supply tray 20 is conveyed onto the platen 34 that is located on a downstream side, as viewed in the second direction 16, of the pair of feed rollers 54, by the drive roller 47 and the pinch roller 48 cooperating to pinch the recording sheet therebetween.

Further, as shown in FIGS. 2 and 4, the pair of discharge rollers 55 are disposed on a downstream side, as viewed in the second direction 16, of the image recording portion 24. The pair of discharge rollers 55 constitute an unit including the drive roller 49 and the spur roller 50 which is located above the drive roller 49 and is held in contact with the drive roller 49. With the drive roller 49 being rotated in a forward direction, the recording sheet having been subjected to image recording is conveyed in the second direction 16, i.e., in a direction toward the sheet exist tray 21, by the drive roller 49 and the spur roller 50 cooperating to pinch the recording sheet therebetween. With the drive roller 49 being rotated in a reverse direction, the media tray 71, which constitutes an example of a tray in the present embodiment, is conveyed in the first direction 15. It is noted that the spur roller (rowel) 50, which is to be in pressing contact at its outer circumferential surface with the recording medium that has been already subjected to image recording, has a sharp-toothed surface as the outer circumferential surface, for avoiding the recorded image from being damaged.

As shown in FIG. 4, the drive roller 47 as one of the feed rollers 54 is rotated when a drive force is transmitted thereto from a conveying motor 59 that is connected to an axial end portion of the drive roller 47. Meanwhile, the drive roller 49 as one of the discharge rollers 55 is rotated by the drive force transmitted from the drive roller 47 via an intermediate gear 57 and a belt 58. Each of the drive rollers 47, 49 is controlled by a drive circuit that is incorporated in ASIC 85 (see FIG. 5), so as to be rotated in a selected one of forward and reverse directions. That is, the direction of rotations of the drive rollers 47, 49 is switchable between the forward and reverse directions, by changing direction of rotation of the conveying motor 59 or changing gears transmitting the drive force from the conveying motor 59 to the rollers 47, 49.

As shown in FIG. 4, a photo interrupter 60 is provided to detect marks or slits of an encoder disk 51 that is rotated together with the drive roller 47. The photo interrupter 60 and the encoder disk 51 cooperate with each other to constitute a rotary encoder 61 (see FIG. 5) to generate signals corresponding to the detected slits of the encoder disk 51. Thus, the rotations of the drive rollers 47, 49 are controlled based on the signals generated by the rotary encoder 61.

As shown in FIG. 2, the recording sheet is intermittently conveyed above the platen 34 in the second direction 16, by the drive rollers 47, 49, with an amount of each intermittent conveyance amount of the sheet corresponding to an amount of line feed. After each intermittent conveyance of the recording sheet, the recording head 30 is moved in the main scanning direction, whereby image recording is performed onto the recording sheet sequentially from its leading end portion to its trailing end portion. After the image recording has been performed onto a predetermined region of the recording sheet, the drive roller 40 is continuously rotated whereby the recording sheet nipped between the drive roller 49 and the spur roller 50 is discharged to the sheet exist tray 21.

(Media Tray 71)

As described above, the compound machine 1 has a function for recording image onto not only a recording sheet but also other recording media such as CD-ROM and DVD-ROM. In the present embodiment, where image is to be recorded onto CD-ROM or DVD-ROM (hereinafter referred to as "recording medium M"), the recording medium M is held on the media tray 71. The media tray 71 holding the recording medium M is introduced into the machine 1 in the first direction 15, while being set on a tray guide 72 that is provided in the opening 4, as shown in FIG. 2.

The media tray 71 is made of resin or other material having a high rigidity, and has a thickness of several millimeters (e.g., 2-3 mm) as measured in the height direction 14. The media tray 71 has a length (as measured in the conveyance direction, i.e., in the depth direction 12) and a width (as measured in the width direction 13), which are larger than the thickness (as measured in the height direction 14). That is, the media tray 71 as a whole has a rectangular parallelepiped body having a small thickness. On an upper surface of the media tray 71, there is provided a media receiving portion (not shown) in the form of a circular-shaped recess in which the recording medium M is to be disposed.

When the media tray 71 is introduced, in a direction indicated by arrow 77, i.e., in the first direction 15, into a straight portion 231 of the conveyance path 23 via the opening 4 that is provided in the front surface of the compound machine 1, as shown in FIG. 2, the introduction of the media tray 71 is detected by a sensor (not shown). Then, when the user commands execution of image recording onto the recording medium M held on the media tray 71 after the detection of the introduction of the media tray 71, the drive roller 49 is rotated in the reverse direction whereby the media tray 71 is conveyed in the first direction 15.

While the media tray 71 holding the recording medium M is being conveyed in the first direction 15 so as to be positioned in a predetermined position, the position of the center of the recording medium M is detected or calculated. When the media tray 71 is being positioned in the predetermined position, a rear end portion (as viewed in the first direction 15) of the recording medium M is positioned on a downstream side (as viewed in the first direction 15) of downstream end ones (as viewed in the first direction 15) of the nozzles 301. In other words, when the media tray 71 is being positioned in the predetermined position, a front end portion (as viewed in the second direction 16) of the recording medium M is positioned on an upstream side (as viewed in the second direction 16) of upstream end ones (as viewed in the second direction 16) of the nozzles 301.

When the media tray 71 has been conveyed to the above-described predetermined position, the rotation of the drive roller 49 is temporarily stopped. Then, the direction of the rotation of the drive roller 49 is switched from the reverse direction to the forward direction, whereby the media tray 71 is conveyed in the second direction 16 so that the recording medium M held on the media tray 71 is also conveyed in the second direction 16 so as to pass over the platen 34. While the recording medium M passing over the platen 34, ink droplets are ejected from the nozzles 301 of the recording head 30 toward the recording medium M, whereby the image is recorded onto a surface of the recording medium M. After the image recording has been thus performed, the media tray 71 is discharged to the tray guide 72 with a portion of the media tray 71 being nipped between the discharge rollers 55.

<Electrical Arrangement>

Figure 5:
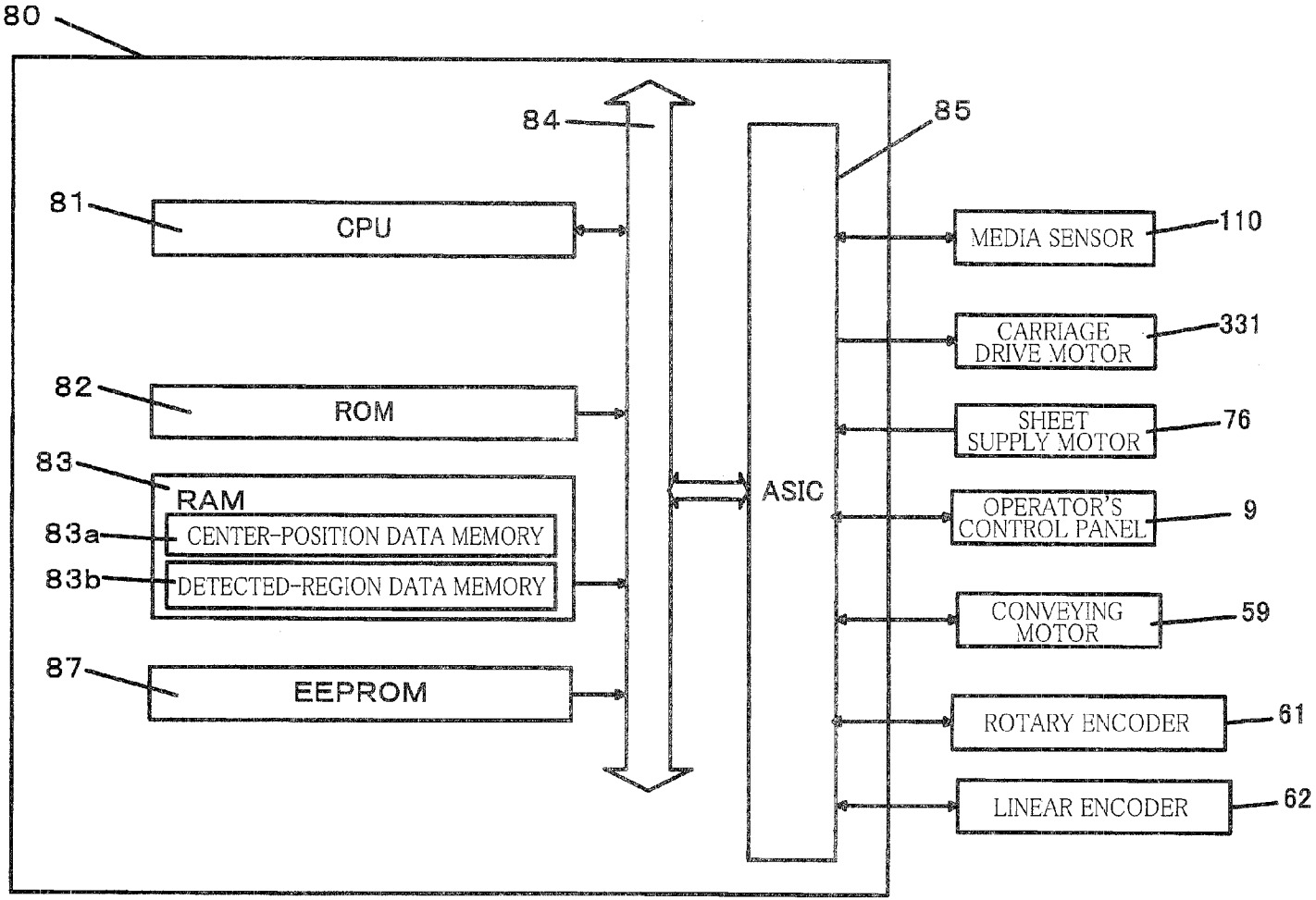
FIG. 5 a block diagram showing construction of a controlling portion 80 included in the compound machine 1.

Referring next to FIG. 5, there will be described an electrical arrangement in the compound machine 1. The controlling portion 80 is provided for controlling all actuations performed in the compound machine 1.

The controlling portion 80 is a microcomputer that is constituted principally by components such as CPU 81, ROM 82, RAM 83 and EEPROM 87 which are connected to the above-described ASIC 85 via a bus 84. The CPU 81 is provided for perform arithmetic processing. The ROM 82 is provided for storing therein control programs and the like. The RAM 93 is provided for serving as a working area or a storage area for temporarily storing various data therein. The EEPROM 87 is provided for storing therein setting information or the like.

The CPU 81 is configured to control the components connected to the ASIC 85 and functions included in the compound machine 1, in accordance with fixed values and programs stored in the ROM 82 and the RAM 83.

The ROM 82 is a non-writable memory storing therein control programs that are to be executed by the compound machine 1. The ROM 82 stores therein, as the control programs, a main routine (FIG. 6) and a print checking routine (FIG. 7). The print checking routine is executed, when a tray-using print mode is selected in the main routine, to check if the recording medium has been already subjected to image recording. The ROM 82 further stores therein a first modification (FIG. 8) and a second modification (FIG. 9) of the print checking routine.

The RAM 83 is used as a working area or a storage area for temporarily storing therein various data that are to be used upon execution of the programs by the CPU 81. Further, the RAM 83 includes portions assigned to serve as other storage areas such as a center-position data memory 83*a* and a detection-region data memory 83*b*. In the present embodiment, the detection-region data memory 83*b* constitutes a detection-region memory portion.

The center-position data memory 83*a* is an area for temporarily storing data relating to the position of the center of the recording medium M in the tray-using print mode. The detection-region data memory 83*b* is an area for temporarily storing therein data relating to a detection region and a characteristic region that are determined based on an image-recorded region of the recording medium M in which the image has been recorded.

The EEPROM 87 keeps storing therein, even after power OFF of the compound machine 1, data relating to determinations and flags that are to be held. For example, the EEPROM 87 is capable of storing therein data representing image of an original document that has been read by the scanner unit 3, so that, once after the image has been read by the scanner unit 3, the data representing the read image can be repeatedly used.

The ASIC 85 is configured to control, in accordance with commands transmitted from the CPU 81, peripheral devices that are connected to the compound machine 1. To the ASIC 85, there are connected various components of the machine 1 such as the above-described media sensor 110, operator's control panel 9, sheet supply motor 76, carriage drive motor 331, conveying motor 59, rotary encoder 61 and linear encoder 62. The ASIC 85 incorporates therein drive circuits for controlling the respective motors. When a drive signal is outputted from the CPU 81 to a selected one or ones of the drive circuits, drive current based on the drive signal is inputted into the corresponding motor or motors from the drive circuit or circuits whereby the corresponding motor or motors are rotated at given rotational speeds in the forward or reverse direction.

<Actuations of Compound Machine 1>

Referring next to FIGS. 6, 7, 10 and 11, there will be described actuations of the compound machine 1 in the present embodiment.

Figure 6:
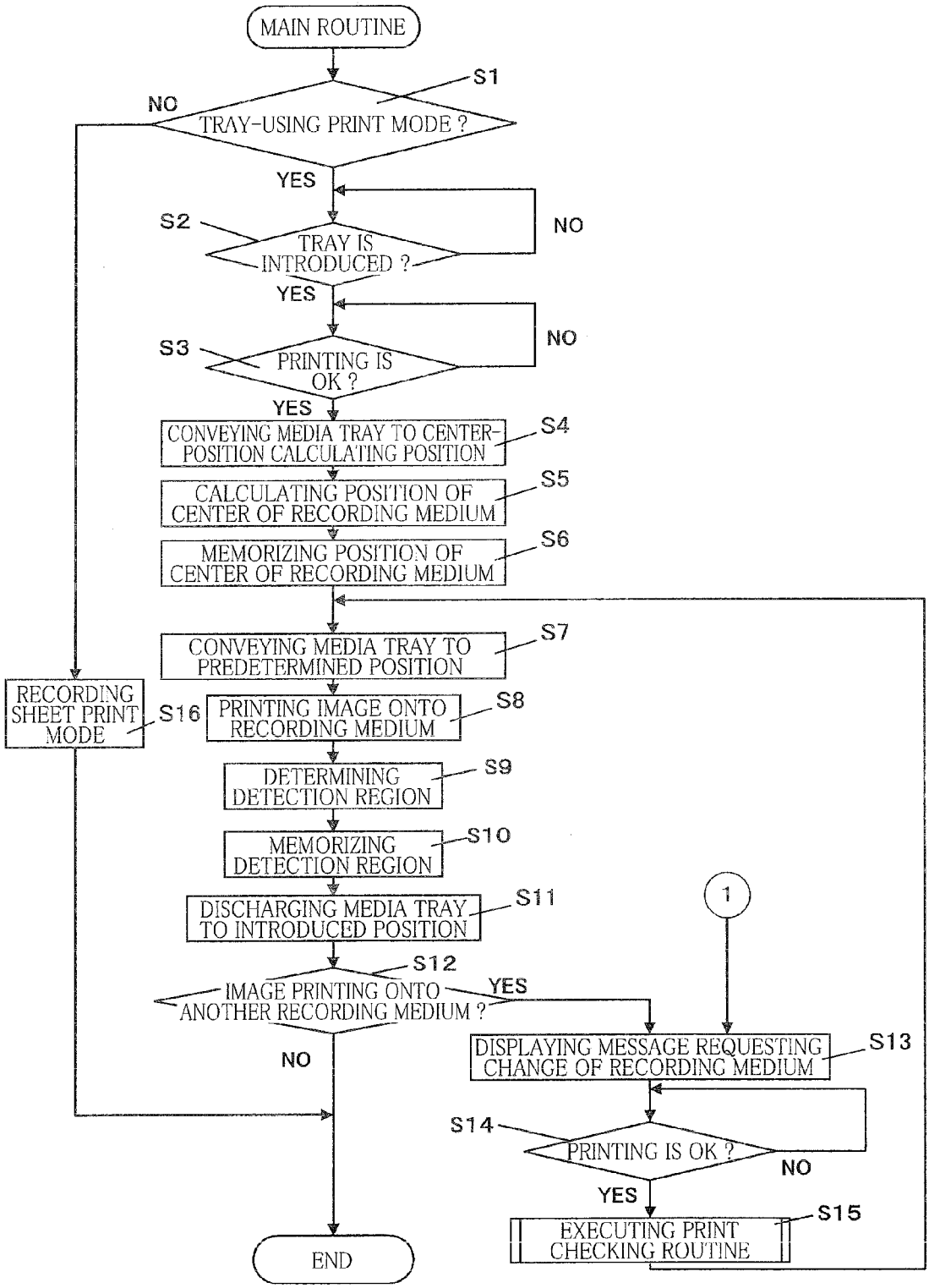
FIG. 6 is a flow chart showing a main routine carried out in the compound machine 1.
Figure 7:
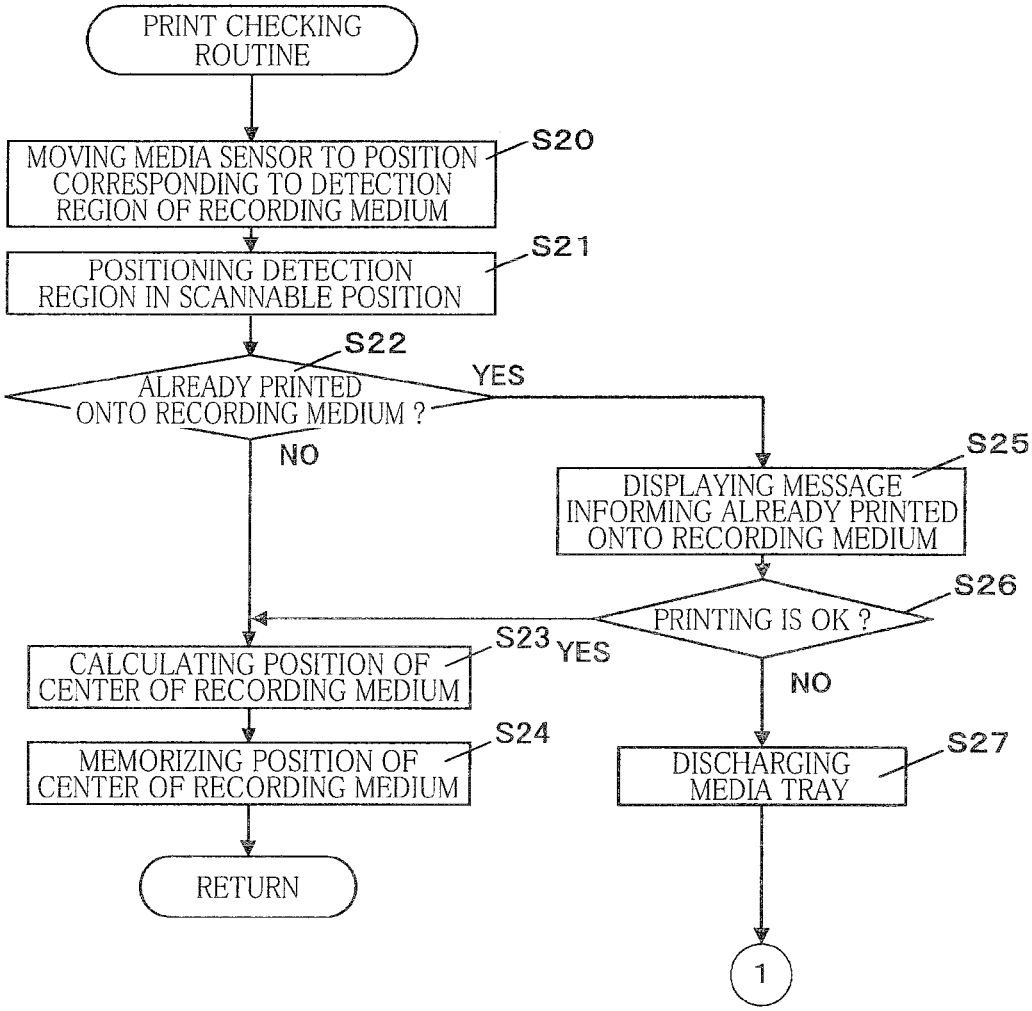
FIG. 7 is a flow chart showing a print checking routine as a sub-routine of the main routine of FIG. 6.

FIG. 6 is a flow chart showing the main routine, which is to be executed by the CPU 81 of the machine 1 when the user selects the printer function from among the various functions such as the printer, scanner, copier and facsimile functions, by operating the operator's control panel 9. The main routine includes a process of checking whether image has been already recorded on a recording medium M that is to be subjected to image recording. This checking process is carried out in a short length of time during the tray-using print mode.

The main routine shown in FIG. 6 is initiated with step S1 in which it is judged whether the compound machine 1 is in the tray-using print mode or not. In the present embodiment, when the printer function is selected by the user, the display portion 11 is caused to display a message requesting the user to determine whether image is to be recorded on a recording sheet or a recording medium M (e.g., CD or DVD). Thus, it is judged whether the tray-using print mode for printing image on a recording medium M has been selected by operation of the operator's control panel 9. When the tray-using print mode is not selected, namely, when a negative decision (NO) is obtained in step S1, the control flow goes to step S16 that is implemented to perform image recording onto a recording sheet. The main routine is completed by implementation of step S16.

When the tray-using print mode is selected, namely, when a positive judgment (YES) is obtained in step S1, step S2 is implemented to judge whether the media tray 71 has been introduced or not, based on detection made by a sensor (not shown). The introduction of the media tray 71 is detected by the sensor when the tray 71 is positioned in a position in which the tray 71 is nipped between the discharge rollers 55 and is supported by the tray guide 72. Step S2 is implemented repeatedly as long as the introduction of the media tray 71 is not detected. When the introduction of the media tray 71 is detected by the sensor, namely, when a positive judgment (YES) is obtained in step S2, step S3 is implemented whereby the display portion 11 is caused to display a message requesting the user to input "Printing is OK". Thus, in step S3, it is judged whether "Printing is OK" has been inputted through the operator's control panel 9. Step S3 is implemented repeatedly as long as the "Printing is OK" is not inputted. When "Printing is OK" is inputted, namely, when a positive judgment (YES) is obtained in step S3, step S4 is implemented whereby the media tray 71 is conveyed to a center-position calculating position. While the media tray 71 is being positioned in the center-position calculating position, the media sensor 110 can detect opposite edge portions of the recording medium M, based on which a position of center of the recording medium M is to be calculated. It is noted that the center-position calculating position is not particularly limited to a certain position but may be any position as long as the opposite edge portions of the recording medium M are detectable while the media tray 71 is being positioned in the center-position calculating position. It is further noted that the opposite edge portions of the recording medium M do not necessarily have to be diametrically opposite to each other but may be any portions lying on periphery of the recording medium M as long as the edge portions are spaced apart from each other.

In step S5, two pairs of opposite edge portions of the recording medium M held on the media tray 71, i.e., four edge portions lying on the periphery of the recording medium M are detected by the media sensor 110, and then the position of the center of the circular-shaped recording medium M is calculated from data representing three of the detected four edge portions. Step S5 is followed by step S6 in which data representing the calculated position of the center of the recording medium M is stored in the center-position data memory 83*a*.

Figure 10:
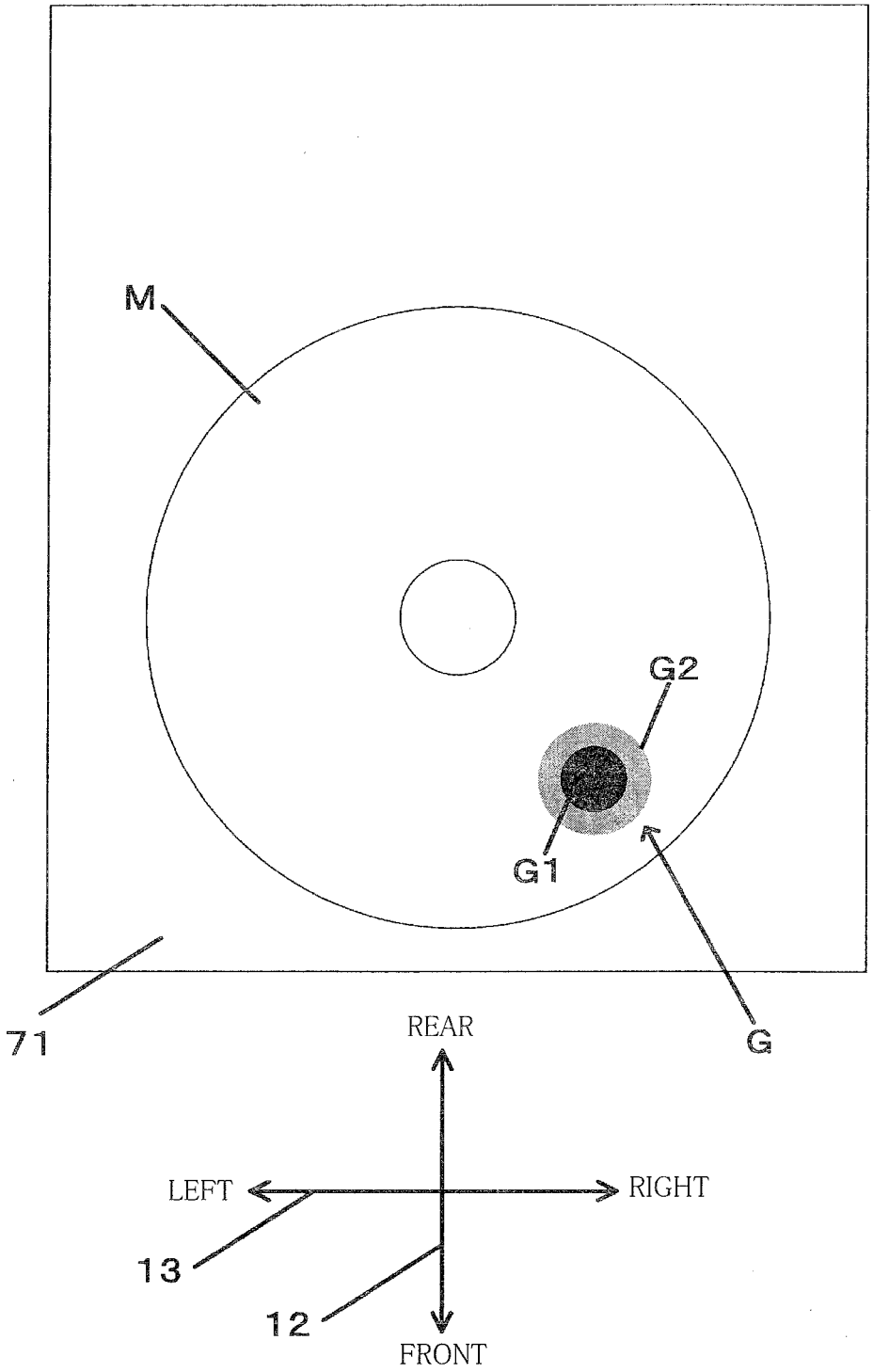
FIG. 10 is a view showing a recording medium M held on a media tray 71.

In step S7, the media tray 71 is conveyed in the first direction 15 (see FIG. 2) so as to be positioned in the above-described predetermined position. When the media tray 71 has been positioned in the predetermined position, the conveyance of the tray 71 is stopped and then step S8 is implemented whereby image printing is performed on the recording medium M while the media tray 71 holding the recording medium M is conveyed in the second direction 16 (see FIG. 2). FIG. 10 shows an image G that is printed on the recording medium M in the present embodiment. The image G consists of a first image part (i.e., high-density part) G1 and a second image part (i.e., low-density part) G2 in which density of the image is lower than in the first image part G1.

Step S8 is followed by step S9 that is implemented to determine a detection region (that is to be detected by the media sensor 110 in a print checking routine described below) of the recording medium M, based on a recorded region of the recording medium M in which the image G has been recorded. In step S10, the detection-region data memory 83*b* memorizes the determined detection region, namely, stores therein data representing the determined detection region. In the present embodiment, a portion of the CPU 81 which is assigned to implement step S9 constitutes a detection-region determining portion. Further, in the present embodiment, the first image part G1 (in which density of the image is higher than in any other part of the image G) is determined as the detection region in step S9, and serves as a characteristic region that is described below.

The recorded region of the recording medium M may be represented by positional relationship between the recording head 30 and the media tray 71 when the image G is recorded onto the recording medium M by the recording head 30. That is, the recorded region may be calculated based on, for example, signals which are supplied from liner encoder 62 and the rotary encoder 61 and which represent positions of the carriage 31 in the main scanning direction and positions of the media tray 71 in the tray conveyance direction when the image G is being recorded onto the recording medium M by the recording head 30. It should be noted that the recorded region does not have to be obtained necessarily after the image G has been recorded onto the recording medium M but may be obtained before the image G is recorded on the recording medium M. In the later case, the recorded region can be obtained based on a position of the image G relative to the recording medium M, which is indicated by data representing the image G.

When the image recording onto the recording medium M has been completed, step S11 is implemented whereby the media tray 71 is discharged to an introduced position which lies on the tray guide 72 and in which the media tray 71 has been introduced into the compound machine 1. In step S12, the display portion 11 is caused to display a message requesting the user to determine whether another recording medium M is to be subjected to the image recording or not. When the image recording is to be performed onto another recording medium, a positive judgment (YES) is obtained whereby the control flow goes to step S13 in which the display portion 11 is caused to display a message requesting the user to change the recording medium M to another recording medium M. Step S13 is followed by step S14 in which he display portion 11 is caused to display a message requesting the user to input "Printing is OK". And, in step S14, it is judged whether "Printing is OK" has been inputted through the operator's control panel 9. Step S14 is implemented repeatedly as long as the "Printing is OK" is not inputted. When "Printing is OK" is inputted, namely, when a positive judgment (YES) is obtained in step S14, step S15 is implemented whereby the print checking routine is executed as described below. After execution of the print checking routine, the control flow goes to step S7. When the image recording is not to be performed onto another recording medium, a negative judgment (NO) is obtained in step S12 whereby one cycle of execution of the main routine is completed.

(Print Checking Routine)

The print checking routine will be described with reference to FIGS. 7 and 11. As described above, in the present embodiment, the first image part G1 (in which density of the image is higher than in any other part of the image G) is determined as the detection region in step S9, and serves as the characteristic region. This is because a high-density part is easily recognizable by the media sensor 110.

Figure 11:
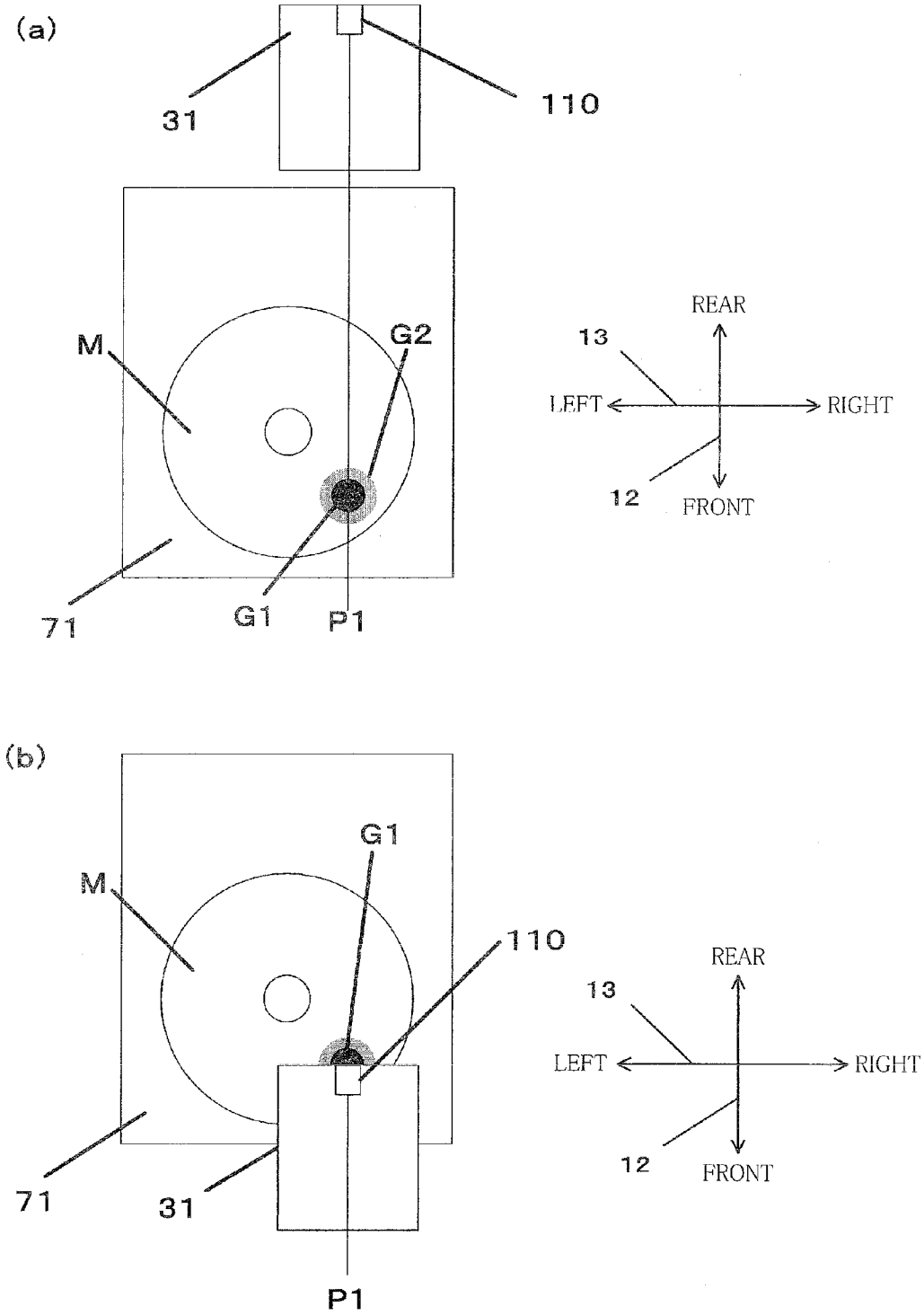
FIG. 11 is a set of views schematically showing a positional relationship between a media sensor 110 and a detection region of the recording medium M, in execution of the print checking routine of FIG. 7.

This print checking routine is initiated with step S20 in which the media sensor 110 is moved to be positioned in a position P1 that is the same or aligned with the first image part G1 (that is memorized as the characteristic region as well as the detection region in the detection-region data memory 83*b*) as viewed in the main scanning direction, as shown in view (a) of FIG. 11

Then, in step S21, the media tray 71 is conveyed such that the first image part G1 is positioned to a scannable position in which the first image part G1 is scannable by the media sensor 110, as shown in view (b) of FIG. 11. Step S21 is followed by step S22 that is implemented to judge whether the image has been already recorded on the recording medium M or not, based on signal that is supplied from the media sensor 110. When the recording medium M has been correctly replaced with another recording medium M, the first image part G1 serving as the characteristic region as well as the detection region is not recognized whereby a negative judgment (NO) is obtained in step S22. When the negative judgment (NO) is obtained in step S22, the control flow goes to step S23 in which the position of the center of the circular-shaped recording medium M is calculated. In this step S23, the media sensor 110 is caused to detect four edge portions which lie on the periphery of the recording medium M and which are located on a downstream side, as viewed in the first direction 15, of a scannable area that is currently scannable by the media sensor 110, and the position of the center of the recording medium M is calculated from data representing three of the detected four edge portions. Step S23 is followed by step S24 in which data representing the calculated position of the center of the recording medium M is stored in the center-position data memory 83*a*. One cycle of execution of the print checking routine is completed with step S24. In the present embodiment, a portion of the CPU 81 which is assigned to implement step S22 constitutes a judging portion.

When the recording medium M has been replaced incorrectly with another recording medium M or has not been replaced with another recording medium M, due to, for example, erroneous operation by the user, the first image part G1 serving as the characteristic region as well as the detection region is detected whereby a positive judgment (YES) is obtained in step S22. When the positive judgment (YES) is obtained in step S22, the control flow goes to step S25 in which the display portion 11 as an informing portion is caused to display a message informing that the image recording has been already performed onto the recording medium M. Step S25 is followed by step S26 that is implemented to receive a determination, which is made by the user, as to whether the image is to be recorded again on the same recording medium M. When the "Printing is OK" is inputted by the user, a positive judgment (YES) is obtained in step S26, and then steps S23 and S24 are implemented as described above. One cycle of execution of the print checking routine is completed with step S24. When "Printing is NG" is inputted by the user, a negative judgment (NO) is obtained in step S26, and then step S27 is implemented to discharge the media tray 71. After implementation of step S27, the control flow goes back to step S13 of the main routine. In the present embodiment, a portion of the CPU 81 which is assigned to implement step S26 constitutes a re-recording-determination receiving portion.

In the present embodiment, the detection region is determined based on the recorded region in which the image has been recorded in previous recording of the image, and the determined detection region is memorized. Prior to next recording of the image, the media sensor 110 and the recording medium M are moved, based on the memorized detection region, so that it is possible to quickly judge whether the recording medium M has been replaced with another recording medium M. Further, in the present embodiment, the high-density part serves as the characteristic region as well as the detection region that is to be detected by the media sensor 110, so that it is possible to easily judge whether the image has been already recorded onto the recording medium M.

(First Modification of Print Checking Routine)

There will be described a first modification of the print checking routine (i.e., step S15 of the main routine shown in FIG. 6), with reference to FIGS. 8 and 12. In the following description of the first modification of the print checking routine, the description is made where the detection region determined in step S9 of the main routine shown in FIG. 6 includes two regions which are parts of the recorded region of the recording medium M and which are spaced apart from each other in the conveyance direction. Further, the first image part G1 (in which density of the image is higher than in any other part of the image G) is determined as the characteristic region.

Figure 8:
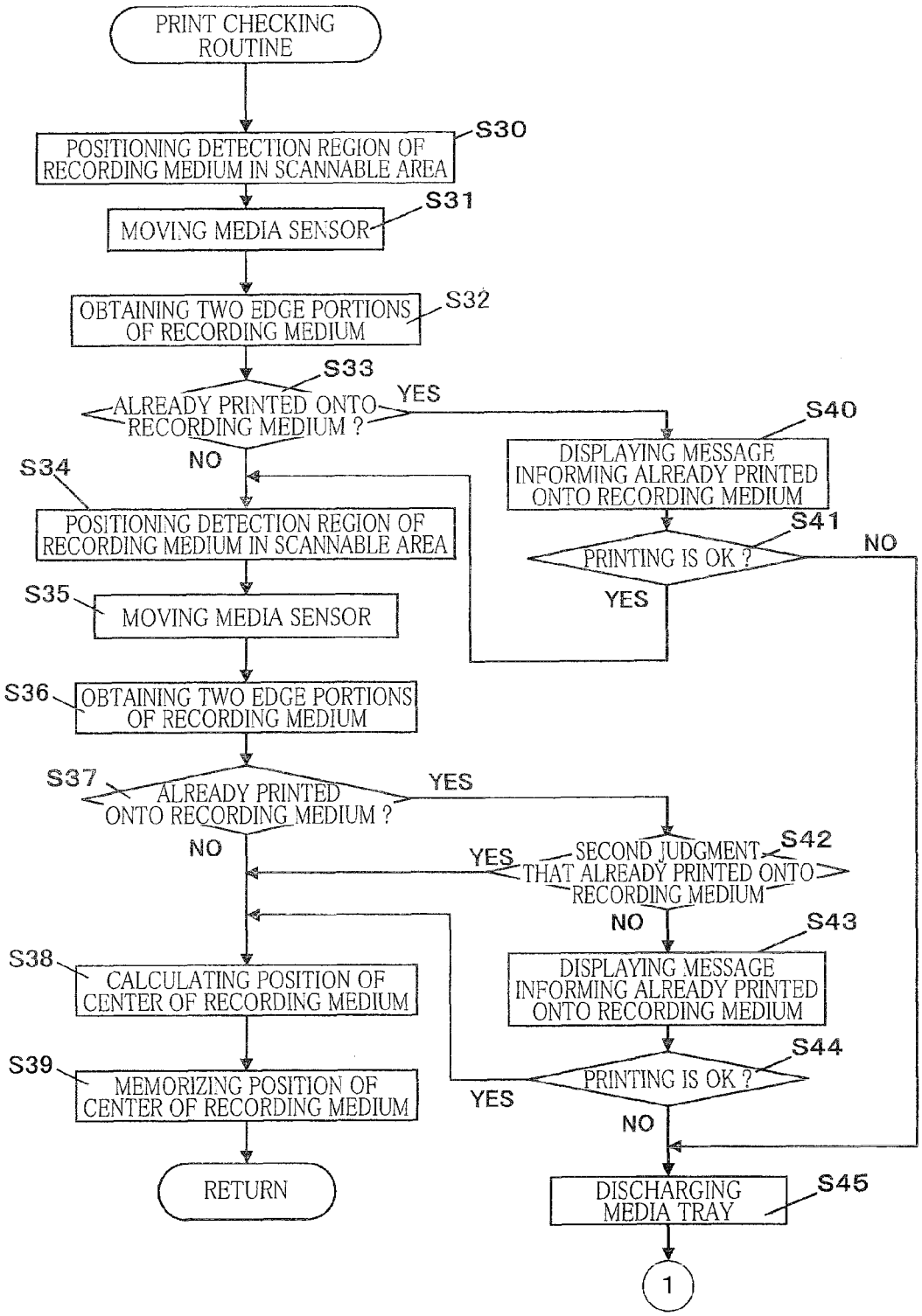
FIG. 8 is a flow chart showing a first modification of the print checking routine.
Figure 12:
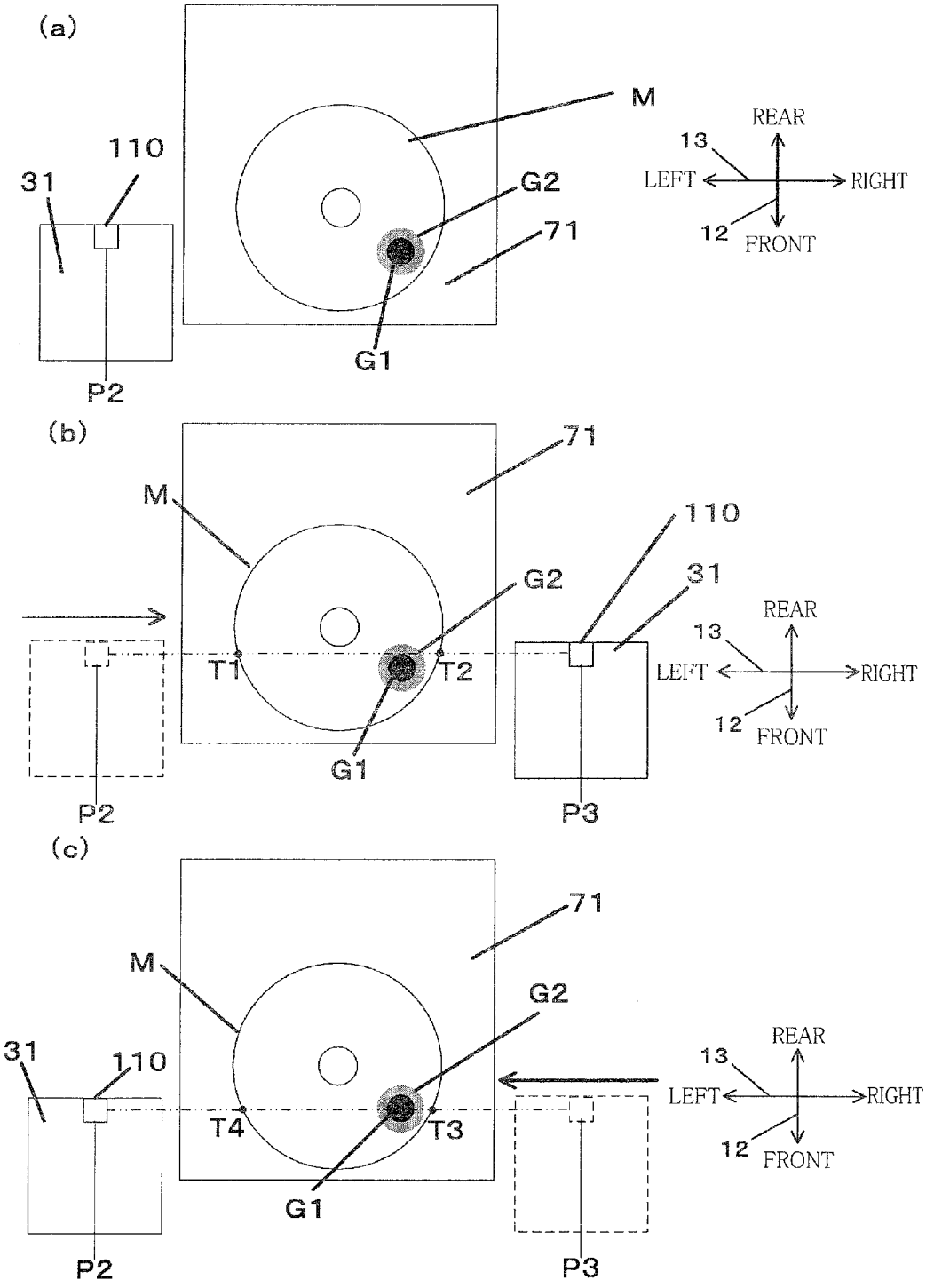
FIG. 12 is a set of views schematically showing a positional relationship between the media sensor 110 and the detection region of the recording medium M, in execution of the print checking routine of FIG. 8.

This print checking routine of FIG. 8 is initiated with step S30 in which the media tray 71 is conveyed to move the recording medium M such that a first one of the two regions of the detection region memorized in the detection-region data memory 83*b* is positioned within the scannable area of the media sensor 110, as shown in view (a) of FIG. 12. In this instance, the media sensor 110 carried by the carriage 31 is positioned in a position P2 that is located outside the recorded region. Then, in step S31, the carriage 31 is moved rightward as seen in FIG. 12 such that the media sensor 110 is moved from the position P2 to a position P3 which is distant from the position P2 by at least a distance corresponding to width of the media tray 71, as shown in view (b) of FIG. 12. In this instance, based on signals supplied from the media sensor 110, data indicative of edge portions T1, T2 of the circular-shaped recording medium M are acquired in step S32, and it is judged in step S33 whether the image has been already recorded onto the recording medium M or not.

When the recording medium M has been correctly changed to another recording medium, the first image part G1 as the characteristic region is not recognized whereby a negative judgment (NO) is obtained in step S33. However, there is a case where the recording medium M disposed on a medium receiving portion (not shown) of the media tray 71 is displaced in the conveyance direction relative to the media tray 71, for example, due to vibration of the machine 1. In such a case, there is a risk that the first image part G1 as the characteristic region is not recognized even where the recording medium M has not been replaced with another recording medium M. In view of such a risk, in step S34, the media tray 71 is conveyed to move the recording medium M such that a second one of the two regions of the detection region memorized in the detection-region data memory 83*b* is positioned within the scannable area of the media sensor 110. Then, in step S35, the carriage 31 is moved leftward as seen in FIG. 12 such that the media sensor 110 is moved from the position P3 to the position P2, as shown in view (c) of FIG. 12. In this instance, based on signals supplied from the media sensor 110, data indicative of edge portions T3, T4 of the circular-shaped recording medium M are acquired in step S36, and it is judged in step S37 whether the image has been already recorded onto the recording medium M or not.

Where the first image part G1 as the characteristic region is not recognized not only in detection of the first one of the two regions of the detection region but also in detection of the second one of the two regions of the detection region, it is judged in step S37 that the recording medium M has been correctly replaced with another recording medium M, so that a negative judgment (NO) is obtained in step S37. Then, the control flow goes to step S38 in which the position of the center of the circular-shaped recording medium M is calculated based on data representing three of the four edge portions of the recording medium M that have been obtained in steps S32 and S36. Step S38 is followed by step S39 in which data representing the calculated position of the center of the recording medium M is stored in the center-position data memory 83*a*. One cycle of execution of the print checking routine is completed with step S39. In the present embodiment, a portion of the CPU 81 which is assigned to implement steps S32 and S36 constitutes an edge-portion-detection controlling portion.

When the recording medium M has been replaced incorrectly with another recording medium M or has not been replaced with another recording medium M, due to, for example, erroneous operation by the user, the first image part G1 serving as the characteristic region is recognized whereby a positive judgment (YES) is obtained in step S33. When the positive judgment (YES) is obtained in step S33, the control flow goes to step S40 in which the display portion 11 as the informing portion is caused to display a message informing that the image recording has been already performed onto the recording medium M. Step S40 is followed by step S41 that is implemented to receive a determination, which is made by the user, as to whether the image is to be recorded again on the same recording medium M. When the "Printing is OK" is inputted by the user, a positive judgment (YES) is obtained in step S41, and then the control flow goes to step S34. When "Printing is NG" is inputted by the user, a negative judgment (NO) is obtained in step S41, and then step S45 is implemented to discharge the media tray 71. After implementation of step S45, the control flow goes back to step S13 of the main routine.

When the recording medium M has been replaced incorrectly with another recording medium M or has not been replaced with another recording medium M, due to, for example, erroneous operation by the user, the first image part G1 serving as the characteristic region is recognized whereby a positive judgment (YES) is obtained in step S37, too. When the positive judgment (YES) has been obtained in step S37, the control flow goes to step S42 in which it is judged whether the recognition of the first image part G1 is made for the second time or not. When the recognition of the first image part G1 is made for the second time, namely, when a positive judgment (YES) is obtained in step S42, the control flow goes to step S38 without via step equivalent to step S41. This is because, when it is judged in step S42 that the recognition of the first image part G1 is made for the second time, it is automatically judged that the "Printing is OK" is inputted by the user, since the "Printing is OK" has been inputted by the user in step S41 although the image had been already recorded onto the recording medium M at that time.

When the detection of the first image part G1 is made for the first time, namely, a negative judgment (NO) is obtained in step S42, the control flow goes to step S43 in which the display portion 11 as the informing portion is caused to display a message informing that the image recording has been already performed onto the recording medium M. Step S43 is followed by step S44 that is implemented to receive a determination, which is made by the user, as to whether the image is to be recorded again on the same recording medium M. When the "Printing is OK" is inputted by the user, a positive judgment (YES) is obtained in step S44, and then the control flow goes to step S38. When "Printing is NG" is inputted by the user, a negative judgment (NO) is obtained in step S44, and then step S45 is implemented to discharge the media tray 71. After implementation of step S45, the control flow goes back to step S13 of the main routine.

In the present embodiment with the first modification of the print checking routine, the detection region is determined based on the recorded region in which the image has been recorded in previous recording of the image, and the determined detection region is memorized. Prior to next recording of the image, the media sensor 110 and the recording medium M are moved, based on the memorized detection region, so that it is possible to quickly judge whether the recording medium M has been replaced with another recording medium M. The high-density part, i.e., the first image part G1 serves as the characteristic region that is to be recognized by the media sensor 110, so that it is possible to easily judge whether the image has been already recorded onto the recording medium M. Further, in the present embodiment with the first modification of the print checking routine, the detection region that is to be detected by the media sensor 110 includes the two regions which are spaced apart from each other in the conveyance direction and which are detected by the media sensor 110 in respective two stages (i.e., in steps S31 and S35), so that it is possible to further accurately make the judgment as to whether the recording medium M has been replaced with another recording medium M. Moreover, the judgment as to whether the recording medium M has been replaced with another recording medium M is made concurrently with detection of the edge portions of the recording medium M for calculation of the position of the center of the recording medium M, so that it is possible to reduce length of time required for acquiring information relating to the recording medium M, which is required for the image recording that is to be performed onto the recording medium M.

(Second Modification of Print Checking Routine)

There will be described a second modification of the print checking routine (i.e., step S15 of the main routine shown in FIG. 6), with reference to FIGS. 9 and 13. In the following description of the second modification of the print checking routine, the description is made where the detection region K determined in step S9 of the main routine shown in FIG. 6 includes, as shown in FIG. 13, not only the first image part G1 as the characteristic region but also shifted regions to each of which the first image part G1 is rotationally shifted in a circumferential direction by a certain amount about a certain portion of the media tray 71, which corresponds to the center of the circular-shaped recording medium M, for example.

When the recording medium M has been correctly changed to another recording medium, the first image part G1 as the characteristic region is not recognized whereby a negative judgment (NO) is obtained in step S33. However, there is a case where the recording medium M disposed on the medium receiving portion (not shown) of the media tray 71 is rotationally displaced relative to the media tray 71, for example, due to vibration of the machine 1. In such a case, there is a risk that the first image part G1 as the characteristic region is not recognized even where the recording medium M has not been replaced with another recording medium M. In view of such a risk, the detection region K is determined such that the determined detection region K includes not only the first image part G1 as the characteristic region but also the above-described shifted regions.

Figure 9:
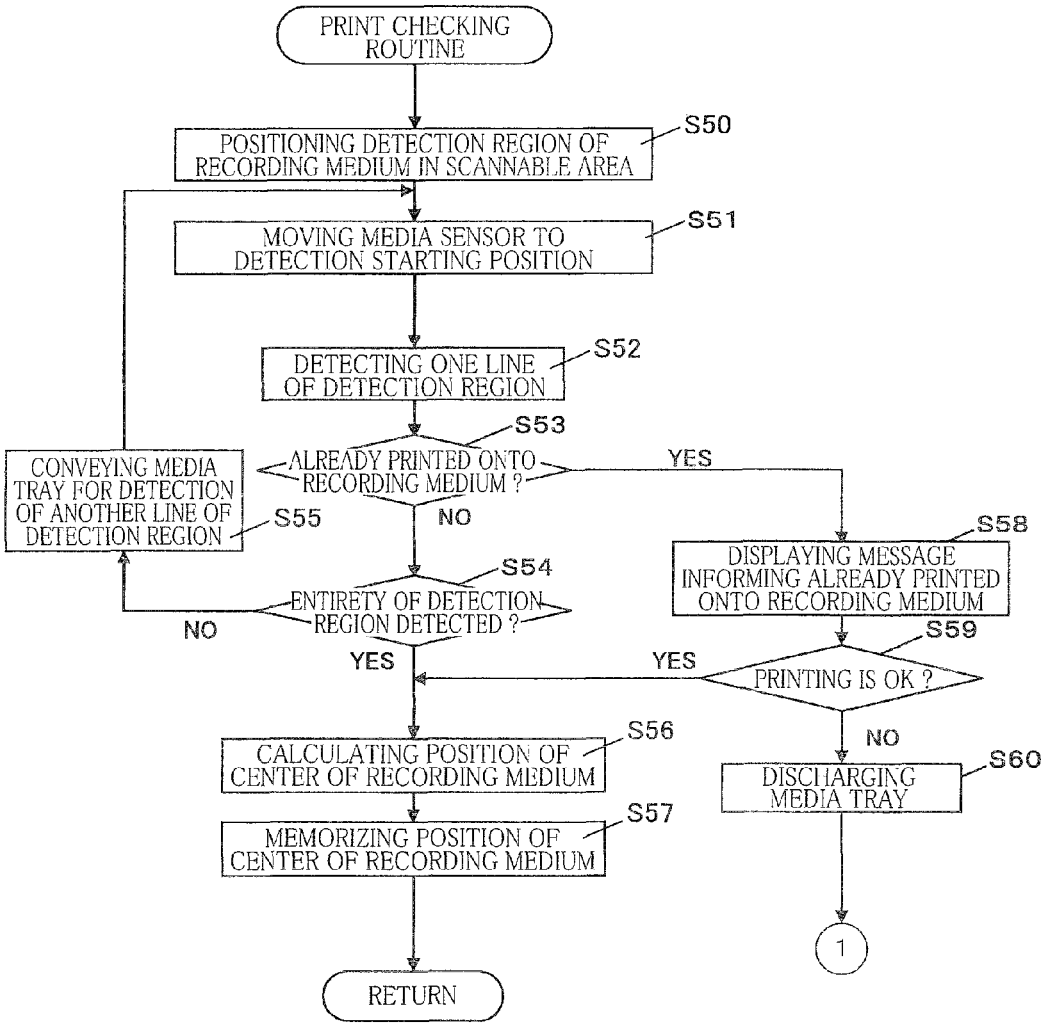
FIG. 9 is a flow chart showing a second modification of the print checking routine.
Figure 13:
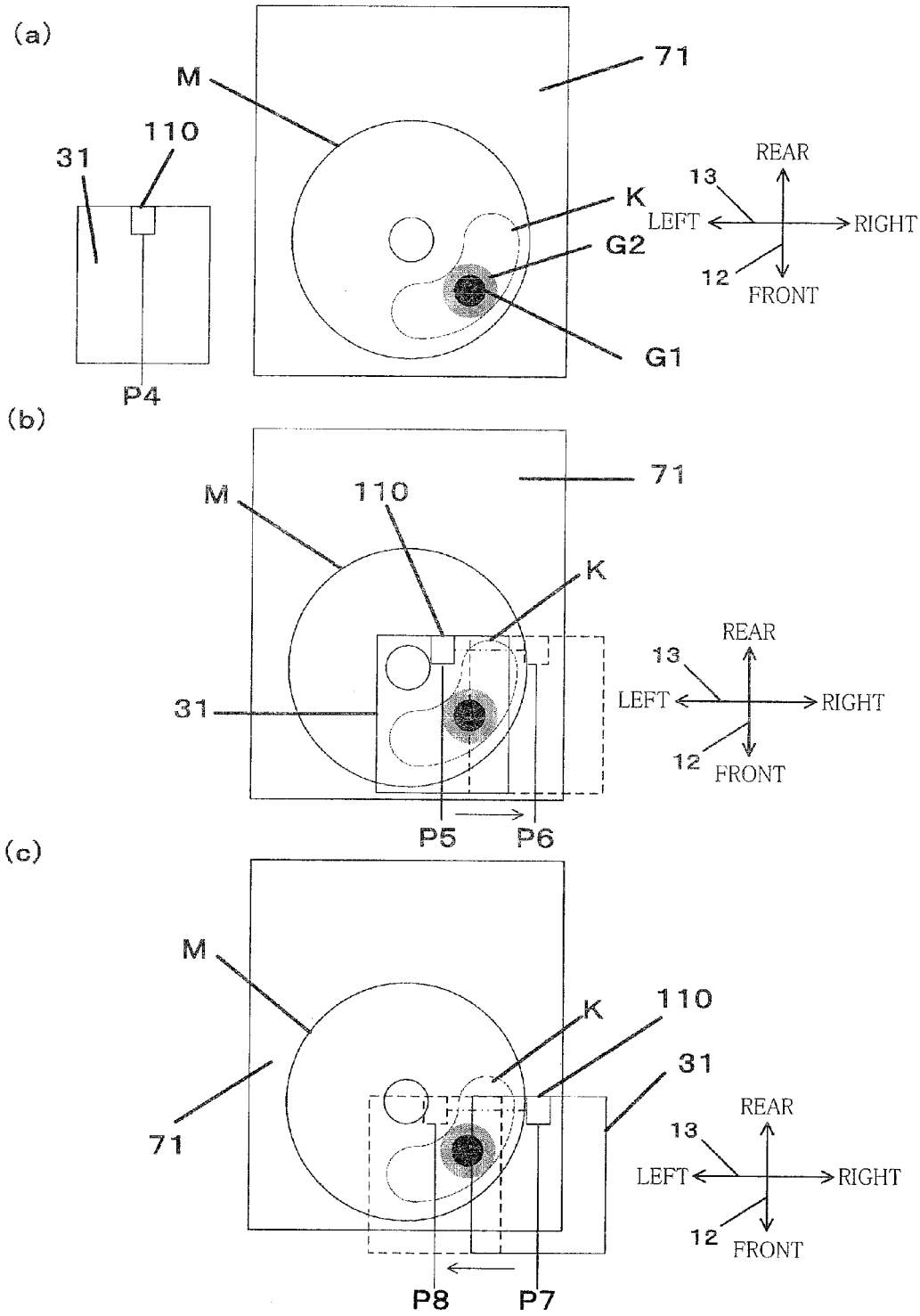
FIG. 13 is a set of views schematically showing a positional relationship between the media sensor 110 and the detection region of the recording medium M, in execution of the print checking routine of FIG. 9.

This print checking routine of FIG. 9 is initiated with step S50 in which the media tray 71 is conveyed to move the recording medium M such that the detection region K (that includes at least a part of the image G) is positioned within the scannable area of the media sensor 110, as shown in view (a) of FIG. 13. In this instance, the media sensor 110 carried by the carriage 31 is positioned in a position P4 that is located outside the recorded region. Then, in step S51, the carriage 31 is moved rightward as seen in FIG. 13 such that the media sensor 110 is moved from the position P4 to a position P5 that is an image detection starting position, as shown in view (b) of FIG. 13. In step S52, the carriage 31 is moved further rightward such that the media sensor 110 is moved from the position P5 to a position PG which is distant from the position P5 by at least a distance corresponding to width of the detection region K, as shown in view (b) of FIG. 13, whereby one line of the detection region K is detected.

Step S52 is followed by step S53 that is implemented to judge whether the image has been already recorded on the recording medium M or not, based on signal that is supplied from the media sensor 110. When the recording medium M has been correctly replaced with another recording medium M, the first image part G1 as the characteristic region is not recognized whereby a negative judgment (NO) is obtained in step S53. However, there is a case where the recording medium M disposed on the medium receiving portion (not shown) of the media tray 71 is rotationally displaced relative to the media tray 71, for example, due to vibration of the machine 1. In such a case, the first image part G1 as the characteristic region is not recognized even where the recording medium M has not been replaced with another recording medium M. In view of this, the detection region K including at least a part of the image G is detected by the media sensor 110 at a plurality of times.

When the negative judgment (NO) has been obtained in step S53, the control flow goes to step S54 that is implemented to judge whether an entirety of the detection region K has been detected or not. As long as the entirety of the detection region K has not yet been detected, a negative judgment (NO) is obtained in step S54. When the negative judgment (NO) is obtained in step S54, the control flow goes to step S55 in which the media tray 71 is conveyed rearwardly by a predetermined distance such that another line of the detection region K is positioned within the scannable area of the media sensor 110, as shown in view (c) of FIG. 13. Then, the control flow goes back to step S51 in which the media sensor 110 carried by the carriage 31 is positioned in a position P7 that is an image detection starting position. In step S52, the carriage 31 is moved leftward such that the media sensor 110 is moved from the position P7 to a position P8 which is distant from the position P7 by at least a distance corresponding to width of the detection region K, as shown in view (c) of FIG. 13, whereby the above-described another line of the detection region K is detected. It should be noted that the another line of the detection region K that is detected in this implementation of step S52 is shifted, in the conveyance direction, from the above-described one line of the detection region K that has been detected in the previous implementation of step S52, by the above-described predetermined distance by which the media tray 71 has been conveyed rearwardly in step S55. Steps S51-S55 are repeatedly implemented until a positive judgment (YES) is obtained in step S54, namely, until the entirety of the detection region K is detected.

When it is judged that the entirety of the detection region has been detected, namely, when the positive judgment (YES) is obtained in step S54, it is judged that the recording medium M has been correctly replaced with another recording medium M, and the control flow goes to step S56 in which the position of the center of the circular-shaped recording medium M is calculated. In this step S56, the media sensor 110 is caused to detect four edge portions which lie on the periphery of the recording medium M and which are located on a downstream side, as viewed in the first direction 15, of a scannable area that is currently scannable by the media sensor 110, and the position of the center of the recording medium M is calculated from data representing three of the detected four edge portions. Step S56 is followed by step S57 in which data representing the calculated position of the center of the recording medium M is stored in the center-position data memory 83*a*. One cycle of execution of the print checking routine is completed with step S57.

When the recording medium M has been replaced incorrectly with another recording medium M or has not been replaced with another recording medium M, due to, for example, erroneous operation by the user, the first image part G1 serving as the characteristic region is detected whereby a positive judgment (YES) is obtained in step S53. When the positive judgment (YES) is obtained in step S53, the control flow goes to step S58 in which the display portion 11 as the informing portion is caused to display a message informing that the image recording has been already performed onto the recording medium M. Step S58 is followed by step S59 that is implemented to receive a determination, which is made by the user, as to whether the image is to be recorded again on the same recording medium M. When the "Printing is OK" is inputted by the user, a positive judgment (YES) is obtained in step S59, and then steps S56 and S57 are implemented as described above. One cycle of execution of the print checking routine is completed with step S57. When "Printing is NG" is inputted by the user, a negative judgment (NO) is obtained in step S59, and then step S60 is implemented to discharge the media tray 71. After implementation of step S60, the control flow goes back to step S13 of the main routine.

In the present embodiment with the second modification of the print checking routine, the detection region is determined based on the recorded region in which the image has been recorded in previous recording of the image, and the determined detection region is memorized. Prior to next recording of the image, the media sensor 110 and the recording medium M are moved, based on the memorized detection region, so that it is possible to quickly judge whether the recording medium M has been replaced with another recording medium M. The high-density part, i.e., the first image part G1 serves as the characteristic region that is to be recognized by the media sensor 110, so that it is possible to easily judge whether the image has been already recorded onto the recording medium M. Further, in the present embodiment with the second modification of the print checking routine, the detection region K that is to be detected by the media sensor 110 includes not only the first image part G1 as the characteristic region but also shifted regions to each of which the first image part G1 is rotationally shifted in a circumferential direction by a certain amount about a certain portion of the media tray 71, so that it is possible to further accurately make the judgment as to whether the recording medium M has been replaced with another recording medium M.

While the presently preferred embodiment of the invention has been described above in detail, it is easily conceivable that the invention is not limited to the details of the illustrated embodiment, but may be otherwise embodied without departing from the sprit of the invention.

For example, in the above-described embodiment, the recording medium M is a circular-shaped medium such as CD or DVD. However, the recording medium M may be otherwise shaped medium such as a square-shaped glossy paper or plastic card, as long as the medium can be subjected to image recording while being disposed on the media tray 71.

In the above-described embodiment, the media sensor 110 is carried by the carriage 31 so as to be moveable together with the carriage 31 in the main scanning direction. However, the media sensor 110 may be arranged to be movable independently of the carriage 31. In this arrangement, there may be provided a mechanism that is configured to move exclusively the media sensor 110 in the main scanning direction.

In the above-described embodiment, the high-density part (in which the density of the image is higher than in any other part of the recorded region) constitutes the characteristic region, so that it is judged whether the image has been already recorded onto the recording medium M or not, depending on whether at least the high-density part as the characteristic region is recognized or not by the media sensor 110. However, the characteristic region may be constituted by any other part of the recorded region such as a low-density region (in which the density of the image is lower than in any other part of the recorded region), as long as it is recognizable by the media sensor 110.

In the embodiment with the first modification of the print checking routine, the detection region is constituted by two regions which are parts of the recorded region of the recording medium M and which are spaced apart from each other in the conveyance direction. However, the detection region may include three or four regions or even more.

In the embodiment with the second modification of the print checking routine, step S52 is implemented to move the media sensor 110 by at least the distance corresponding to width of the detection region K, for thereby detecting one line of the detection region K. However, the length of one line of the detection region K, which is to be detected by the media sensor 110 in this step S52, may be smaller than or equal to the width of the detection region K.

What is claimed is:

1. An image recording apparatus comprising:

a tray configured to hold a disk;

a conveying portion configured to convey said tray in a conveyance direction that is perpendicular to a main scanning direction;

a recording portion configured to print an image onto the disk that is held by said tray;

a detecting portion movable in the main scanning direction and configured to detect the disk and said tray;

a detection-region determining portion configured to determine, based on the image printed in a recorded region of the disk, a detection region of the disk having at least a part of the image printed therein, the detection region being to be detected by said detecting portion, the detection region including at least a part of the recorded region;

a detection-region memory portion configured to memorize a position of the detection region that has been determined by said detection-region determining portion;

a controlling portion configured to cause, prior to a next printing of the image onto a disk that is held by said tray, moving said detecting portion to said detection region, by controlling said conveying portion and said detecting portion, based on the position of the detection region that has been memorized in said detection-region memory portion in previous printing of the image; and a judging portion configured to judge whether the image has been already printed onto the disk or not, based on a result of a detection of the at least a part of the image made by said detecting portion at said detection region.

2. The image recording apparatus according to claim 1, wherein said controlling portion is configured to cause said conveying portion to convey said tray such that the detection region whose position has been memorized in said detection-region memory portion is positioned within a scannable area that is scannable by said detecting portion.

3. The image recording apparatus according to claim 2, wherein said controlling portion is configured, before the detection region is positioned within the scannable area, to cause said detecting portion to be positioned in the same position as the detection region in the main scanning direction.

4. The image recording apparatus according to claim 1, wherein said controlling portion includes an edge-portion-detection controlling portion configured to cause said detecting portion to detect at least three edge portions of the disk, for thereby calculating a center of the recording medium, and wherein said controlling portion is configured, upon detection of at least one of the at least three edge portions of the disk by said detecting portion, to cause the detection region to be positioned within a scannable area that is scannable by said detecting portion, for thereby causing said detecting portion to detect the at least one of the at least three edge portions of the disk and the detection region of the disk.

5. The image recording apparatus according to claim 1, comprising an informing portion configured to inform that the image has been already printed onto the disk, when it is judged by said judging portion that the image has been already printed onto the disk.

6. The image recording apparatus according to claim 1, wherein said controlling portion is configured to cause said conveying portion to discharge said tray that holds the disk, when it is judged by said judging portion that the image has been already printed onto the disk.

7. The image recording apparatus according to claim 1, comprising a re-recording-determination receiving portion configured, when it is judged by said judging portion that the image has been printed onto the disk, to receive a determination as to whether the image is to be printed again on the disk or not, and wherein said controlling portion is configured to cause said recording portion to print the image again onto the disk when the received determination is that the image is to be printed again on the recording medium, and to cause said conveying portion to discharge said tray that holds the disk when the received determination is that the image is not to be printed again on the disk.

8. The image recording apparatus according to claim 1, wherein said detection-region determining portion is configured to determine the detection region such that the determined detection region includes a characteristic region that is a part of the recorded region in which the image has been printed by said recording portion in previous printing of the image.

9. The image recording apparatus according to claim 8, wherein said detection-region determining portion is configured to determine, as the characteristic region, a high-density part of the recorded region in which a density of the image is higher than in any other part of the recorded region.

10. The image recording apparatus according to claim 8, wherein said detection-region determining portion is configured to determine the detection region such that the determined detection region consists of the characteristic region.

11. The image recording apparatus according to claim 8, wherein said detection-region determining portion is configured to determine the detection region such that the determined detection region is larger than the characteristic region as measured in the main scanning direction.

12. The image recording apparatus according to claim 8, wherein said detection-region determining portion is configured to determine the detection region such that the determined detection region includes (i) the characteristic region and (ii) a shifted region to which the characteristic region is shifted in the conveyance direction.

13. The image recording apparatus according to claim 8, wherein said detection-region determining portion is configured to determine the detection region such that the determined detection region includes (i) the characteristic region and (ii) a shifted region to which the characteristic region is shifted in a circumferential direction about a certain portion of said tray.

14. The image recording apparatus according to claim 1, wherein said detection-region determining portion is configured to determine the detection region such that the determined detection region includes a plurality of regions that are spaced apart from each other in the conveyance direction.

15. The image recording apparatus according to claim 1, wherein said recording portion is configured to print the image into the recorded region that is at least a part of a surface of the disk, and wherein said detection-region determining portion is configured to determine the detection region such that the determined detection region is a part of the surface of the disk.

* * * * *